US009525239B2

(12) United States Patent
Shinmi et al.

(10) Patent No.: US 9,525,239 B2
(45) Date of Patent: Dec. 20, 2016

(54) CONNECTOR DEVICE

(71) Applicant: YAZAKI CORPORATION, Minato-ku, Tokyo (JP)

(72) Inventors: Yoshifumi Shinmi, Shizuoka (JP); Fumie Hino, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/856,619

(22) Filed: Sep. 17, 2015

(65) Prior Publication Data

US 2016/0006174 A1 Jan. 7, 2016

Related U.S. Application Data

(63) Continuation of application No. PCT/JP2014/057228, filed on Mar. 18, 2014.

(30) Foreign Application Priority Data

Mar. 19, 2013 (JP) ..... 2013-056161

(51) Int. Cl.
*H01R 13/64* (2006.01)
*H01R 13/631* (2006.01)

(52) U.S. Cl.
CPC ..... *H01R 13/631* (2013.01); *H01R 13/6315* (2013.01); *H01R 13/64* (2013.01); *F02D 2200/0602* (2013.01); *F02D 2400/22* (2013.01)

(58) Field of Classification Search
CPC ... H01R 13/6315; H01R 13/631; H01R 13/64; H01R 13/74; H01R 13/629
(Continued)

(56) References Cited

U.S. PATENT DOCUMENTS 3,755,771 A * 8/1973 Brush ..... H01R 13/629 439/248
4,209,891 A * 7/1980 Lamb ..... E21B 33/038 166/341
(Continued)

FOREIGN PATENT DOCUMENTS

JP S61-080579 U 5/1986
JP S64-056161 U 4/1989
(Continued)

OTHER PUBLICATIONS

Official Action issued on Oct. 20, 2016 in the counterpart Chinese application.

*Primary Examiner* — Hien Vu
(74) *Attorney, Agent, or Firm* — Mots Law, PLLC

(57) ABSTRACT

A connector device includes: a wire harness side connector including a first housing part disposing a female terminal; and a sensor side connector including a second housing part disposing a male terminal. The female and male terminals are connected together at the position where the fitting together of the first and second housing parts is complete. The wire harness side connector includes a third connector rotatably attached to the first housing part. The third connector includes a third housing part in which the orientation of a connector fitting part is varied by the rotating direction of the first housing part. The third housing part includes a rotation preventing rib. The first housing part includes a rotation enabling ring groove, rotation preventing walls provided at intervals farther in the direction of fitting than the rotation enabling ring groove, and rib fitting grooves formed in the gaps between adjacent rotation preventing walls.

3 Claims, 14 Drawing Sheets

(58) Field of Classification Search
USPC ..... 439/246, 247, 374, 376
See application file for complete search history.

(56) References Cited

U.S. PATENT DOCUMENTS

| | | | | |
|---|---|---|---|---|
| 4,802,861 | A | 2/1989 | Gaston | |
| 6,062,713 | A * | 5/2000 | Renlge | B63B 45/00 362/477 |
| 6,364,681 | B1 | 4/2002 | Watanabe | |
| 7,081,001 | B1 * | 7/2006 | Conroy | H01R 13/625 439/314 |
| 7,677,910 | B2 * | 3/2010 | Yoshida | H01R 9/16 439/246 |
| 2003/0045161 | A1 | 3/2003 | Endo et al. | |
| 2010/0003841 | A1 | 1/2010 | Metzler et al. | |

FOREIGN PATENT DOCUMENTS

| | | | |
|---|---|---|---|
| JP | H02-501340 | A | 5/1990 |
| JP | 2000-182702 | A | 6/2000 |
| JP | 2003-157932 | A | 5/2003 |
| JP | 2010-118224 | A | 5/2010 |
| WO | 88/10525 | A1 | 12/1988 |
| WO | 2013/114679 | A1 | 8/2013 |

* cited by examiner

CONNECTOR DEVICE

CROSS REFERENCE TO RELATED APPLICATIONS

This application is a continuation of International Application No PCT/JP2014/057228, filed Mar. 18, 2014, and based upon and claims the benefit of priority from Japanese Patent Application No. 2013-056161, filed Mar. 19, 2013, the entire contents of all of which are incorporated herein by reference.

TECHNICAL FIELD

The present application relates to a connector device which electrically connects respective terminals with each other by fitting between both housing parts.

BACKGROUND ART

As for this type of connector device, there have been proposed a variety of devices conventionally (see JP 2000-182702 A (PTL 1) and US 2010/0003841 A1 (PTL 2)). A first conventional example of such connector devices is illustrated in FIG. 1. In FIG. 1, a connector device 50 according to the first conventional example is installed in a cylinder head 70 of an engine to pick up an output of a built-in fuel pressure sensor element (not illustrated). The connector device 50 includes a wire harness side connector 51 and a sensor side connector 60.

The wire harness side connector 51 includes a housing part 52. A first terminal 53 is disposed in an interior portion on one end side of the housing part 52. An external terminal 54 is disposed in an interior portion on the other end side of the housing part 52. The first terminal 53 is connected to the external terminal 54 through wires W accommodated in the housing part 52. The housing part 52 includes a connector fitting part 52*a* housing the external terminal 54. An external connector (not illustrated) is fitted to the connector fitting part 52*a*.

The sensor side connector 60 includes a sensor body part 61 in which a sensor element (not illustrated) is disposed, and a housing part 63 which is fixed to the sensor body part 61 and in which a second terminal 62 is disposed. A threaded part 61*a* is formed on the outer circumference of the sensor body part 61. By screwing the sensor body part 61 into a threaded hole 70*a* of the cylinder head 70, the sensor side connector 60 is installed in the cylinder head 70.

With the above mentioned constitution, the sensor side connector 60 is installed in the cylinder head 70 and thereafter, a head cover 71 is mounted on the cylinder head 70. Then, the wire harness side connector 51 is inserted into a hole 71*a* of the head cover 71 and fitted to the sensor side connector 60.

As a second conventional example, additionally, a connector device illustrated in FIG. 2 is also proposed. In FIG. 2, a connector device 80 according to the second conventional example has a circular cross section and is connected to a glow plug (not illustrated), as a plug-in connector for a diesel engine. The connector device 80 includes a resinous base body 84 having three coaxially arranged contact shoes 81 to 83, a housing part cap 85 having locking means (not illustrated) for locking the connector device 80 to another glow-plug connector, and a plurality of contact lugs 86 connected to an engine control unit (not illustrated) through wires (not illustrated).

SUMMARY

In the first conventional example, the sensor side connector 60 is screw fastened to the threaded hole 70*a* of the cylinder head 70. Accordingly, the rotational position (orientation) of the housing part 63 of the sensor side connector 60 is so non-constant that there arises a problem of variation in orientation of an opening of the connector fitting part 52*a* formed in the housing part 51 of the wire harness side connector 51. For this reason, it has been requested to arrange the connector fitting part 52*a* to a desired direction depending on the wiring position and direction of a wire for the external connector.

Additionally, it is noted that when fitting the wire harness side connector 51, the housing part 63 of the sensor side connector 60 is located deep in the hole 71*a* of the head cover 71. Therefore, the housing part 63 of the sensor side connector 60 cannot be visually recognized clearly, so that it is difficult to align the housing part 52 of the wire harness side connector 51 with a formal fitting rotational position with respect to the housing part 63 of the sensor side connector 60, causing a problem of inferior fitting workability.

There is the same request and problem on the connector device 80 according to the second conventional example.

In order to solve the above mentioned problem, therefore, an object of the present application is to provide a connector capable of arranging a connector fitting part to which an external connector is fitted, to a desired orientation.

A connector device according to an aspect of the present application includes a first connector including a first housing part in which a first terminal is disposed, and a second connector including a second housing part in which a second terminal is disposed. By fitting the first housing part and the second housing part together, the first terminal and the second terminal are connected together at a fitting complete position of the first housing part and the second housing part. The first connector includes a third connector rotatably attached to the first housing part. The third connector includes a third housing part including a connector fitting part. An orientation of the connector fitting part is varied by the rotating direction of the first housing part. One of the first housing part and the third housing part is provided with a rotation preventing rib. The other of the first housing part and the third housing part is provided with: a rotation enabling ring groove in which the rotation preventing rib can be disposed rotatably; a plurality of rotation preventing walls provided at intervals farther in the direction of fitting than the rotation enabling ring groove; and a plurality of rib fitting grooves, each of which is formed in a gap between adjacent rotation preventing walls and which are capable of fitting the rotation preventing rib.

The rotation preventing rib may be provided with a slide concave groove. Either the first housing part or the third housing part, which is provided with the rotation enabling ring groove, may be provided with an annular slide convex part which can be inserted into the slide concave groove. Then, in such a situation that the rotation preventing rib is rotatably arranged in the rotation enabling ring groove, the slide convex part is inserted into the slide concave groove. One of the first housing part and the second housing part may be provided with a guide rib. The other of the first housing part and the second housing part may be provided with a rotating direction guide part which guides the guide rib in a manner that even if the guide rib is positioned at any rotational position, the first housing part and the second housing part would be brought into a formal fitting rotational position by a position previous to the time when the first terminal and the second terminal start to come into contact with each other.

With the connector device according to the aspect of the present application, in such a situation that the rotation preventing rib is arranged in the rotation enabling ring groove, the first housing part is rotatable to the third housing part. Thus, provided that the orientation of the first housing part is set so that the orientation of the opening of the connector fitting part becomes a desired orientation and additionally, with this orientation, the first housing part and the third housing part are displaced in the direction to deepen their fitting so that the rotation prevention rib is fitted to any rib fitting groove, then the third connector is fixed to the first connector at this rotational position. Consequently, as the third connector can be fitted to the first connector with the connector fitting part arranged in the desired orientation, it is possible to arrange the connector fitting part in a desired orientation corresponding to the wiring position or direction of a wire for an external connector.

DESCRIPTION OF EMBODIMENTS

An embodiment of the present application will be described with reference to FIGS. 3 to 14.

Figure 1:
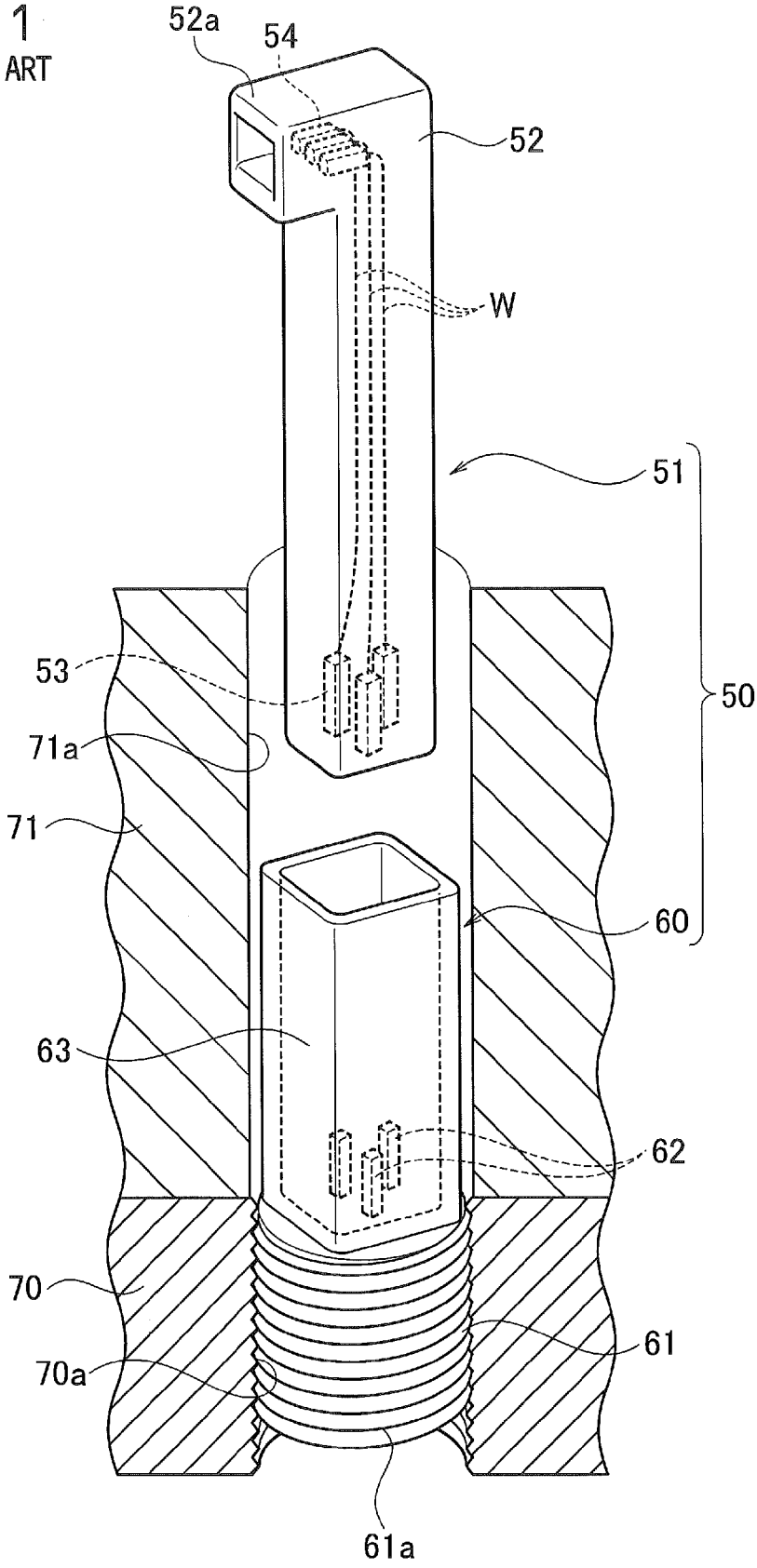
FIG. 1 PRIOR ART
FIG. 1 is a schematic perspective view of a connector device in a first conventional example.
Figure 2:
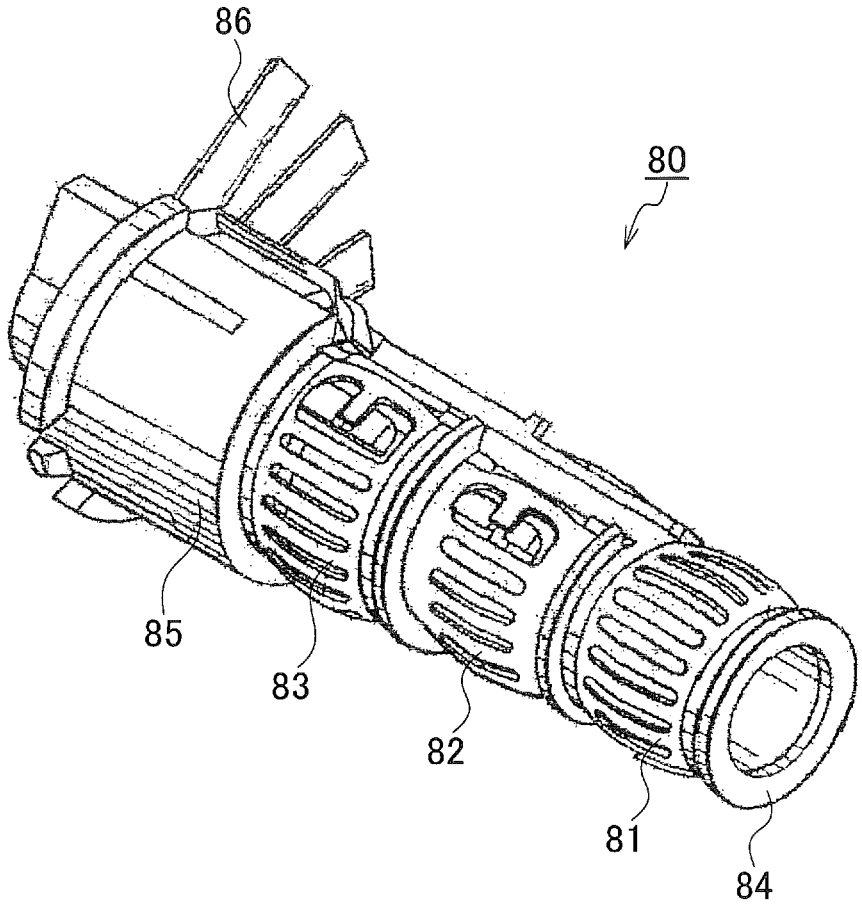
FIG. 2 PRIOR ART
FIG. 2 is a schematic perspective view of a connector device in a second conventional example.
Figure 3:
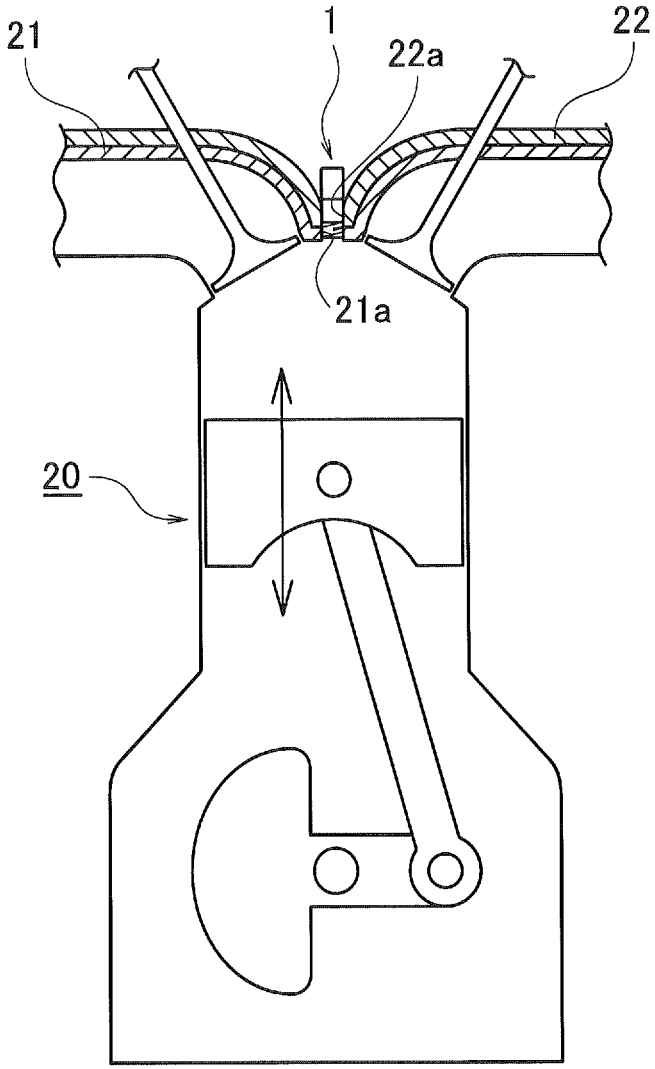
FIG. 3 is a schematic sectional view illustrating a condition that a connector device according to an embodiment is installed in a cylinder head of an engine.

A connector device 1 according to the embodiment includes a combustion pressure sensor element (not illustrated) integrally and is installed in a cylinder head 21 of an engine 20, as illustrated in FIG. 3.

Figure 4:
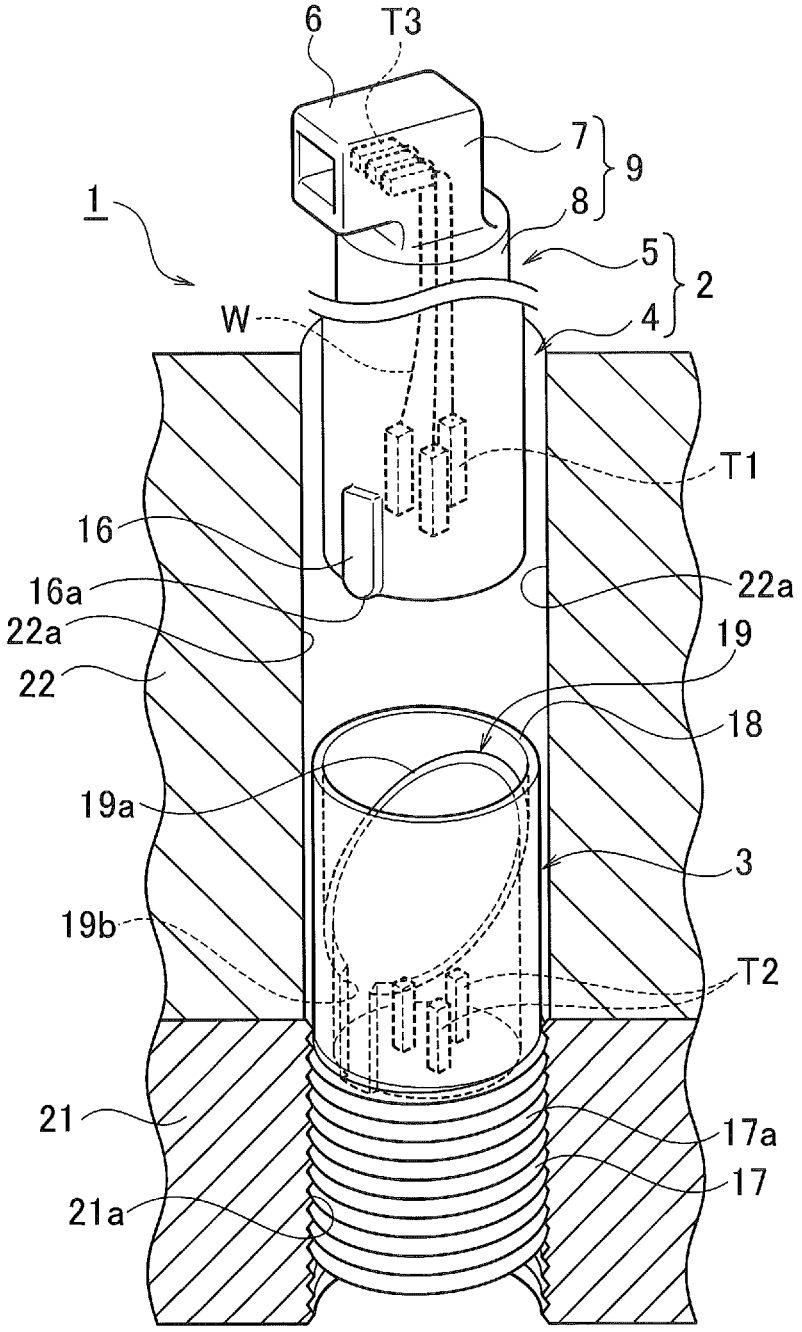
FIG. 4 is a perspective view of the connector device according to the embodiment in a condition before fitting.
Figure 5A:
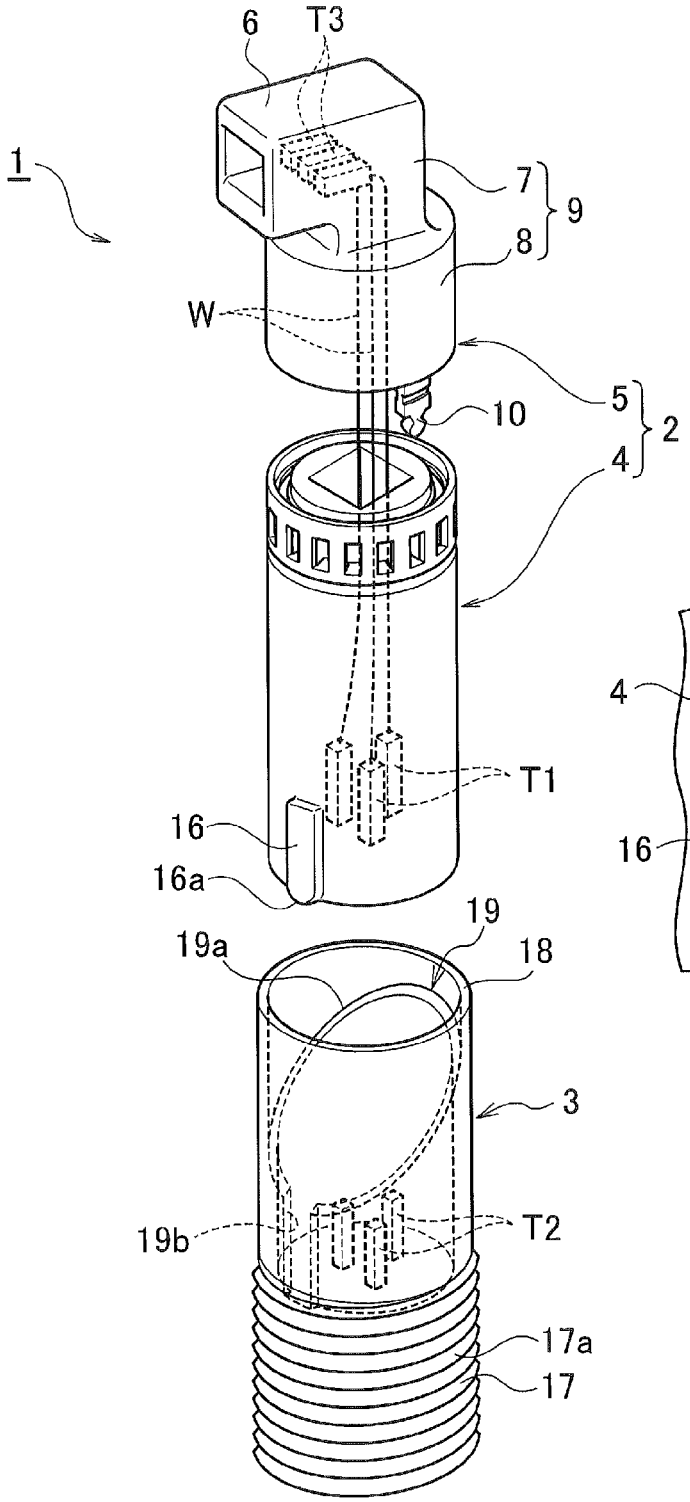
FIG. 5A is an exploded perspective view of the connector device according to the embodiment.

As illustrated in FIGS. 4 and 5, the connector device 1 according to the embodiment includes a wire harness side connector 2 as a first connector, and a sensor side connector 3 as a second connector. The wire harness side connector 2 includes a first housing part 4 in which a female terminal T1 as a first terminal is disposed, and a third connector 5 rotatably attached to the first housing part 4.

The third connector 5 includes a third housing part 9. The third housing part 9 includes a body part 7 including a connector fitting part 6 housing an external terminal T3 as a third terminal, and a cylindrical part 8 provided integrally with the body part 7. In the connector fitting part 6, a direction generally perpendicular to the fitting direction between the first housing part 4 and the third connector 5 is defined as "fitting direction" of the connector fitting part 6. An external connector (not illustrated) of a vehicle body side wire harness is fitted to the connector fitting part 6. The external terminal T3 and the female terminal T1 are connected to each other through a wire W accommodated in the first housing part 4 and the third housing part 9.

Figure 7:
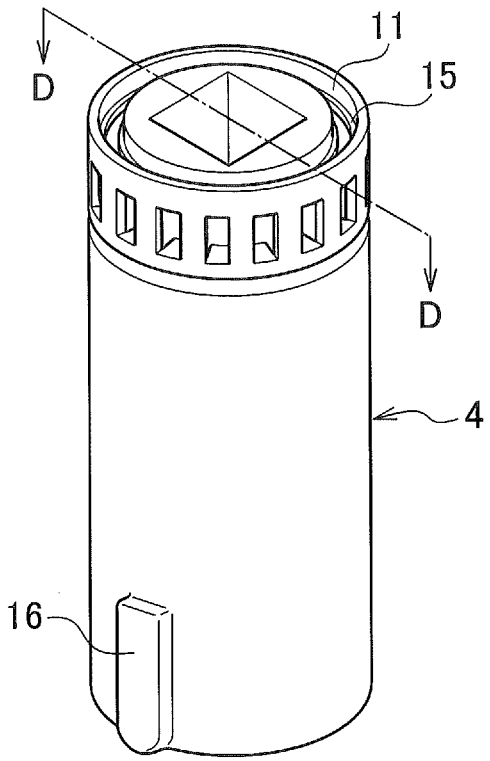
FIG. 7 is a front view of a first housing part of the connector device according to the embodiment.
Figure 8B:
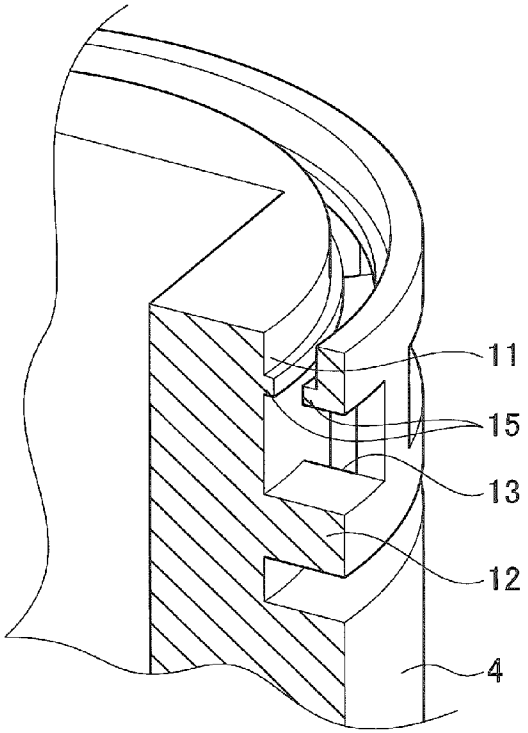
FIG. 8B is an enlarged sectional view of a portion A of FIG. 8A.
Figure 8A:
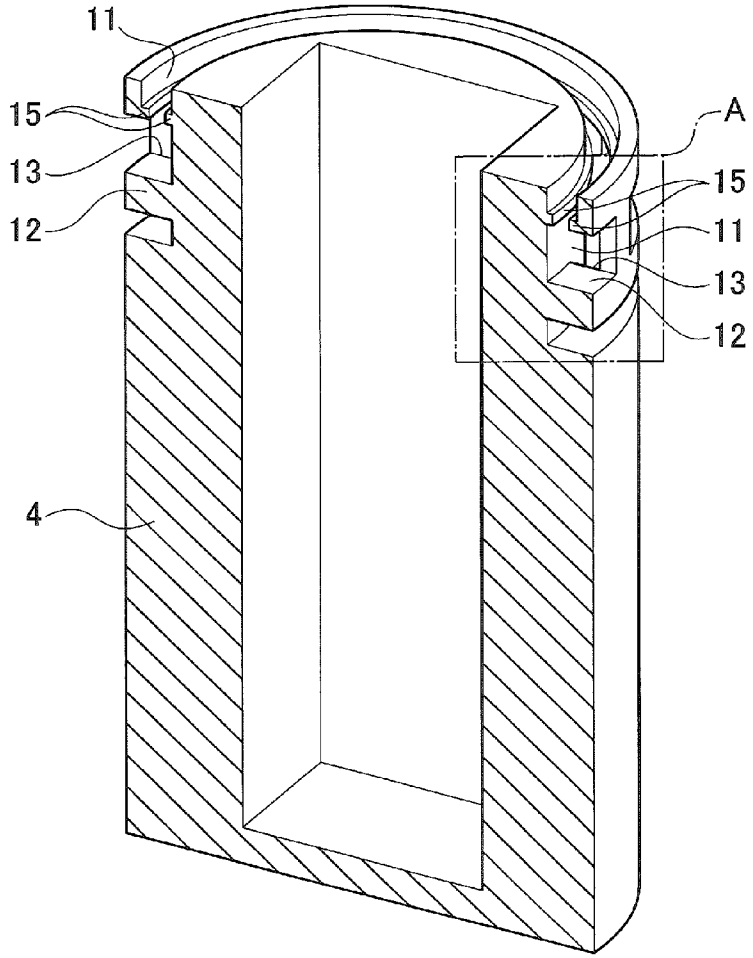
FIG. 8A is a sectional view taken along a line D-D of FIG. 7.
Figure 9:
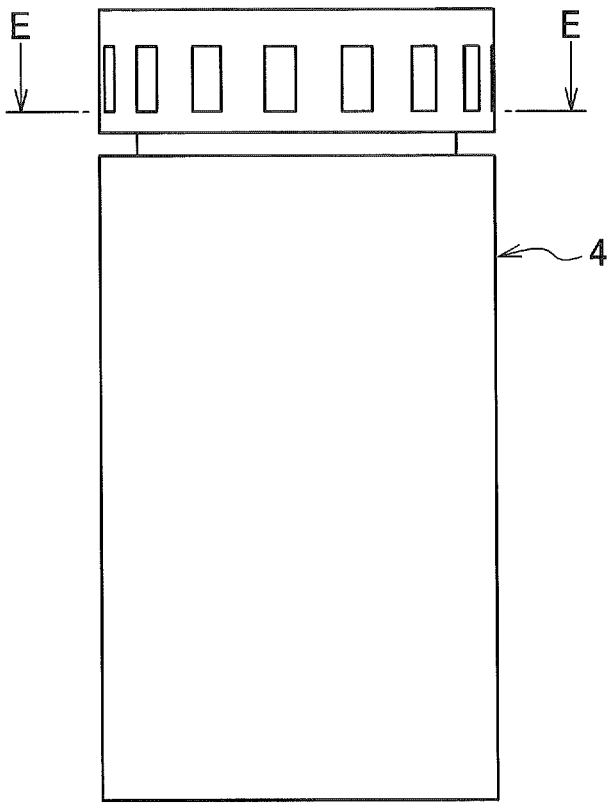
FIG. 9 is a front view of the first housing part of the connector device according to the embodiment.
Figure 10:
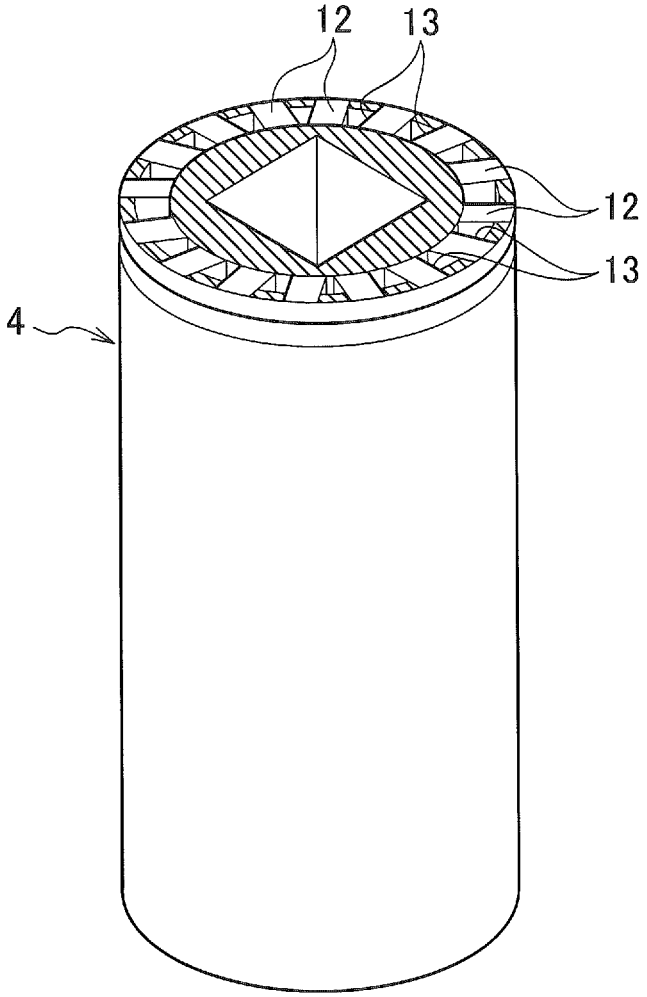
FIG. 10 is a perspective view of the part cut along a line E-E of FIG. 9.
Figure 11A:
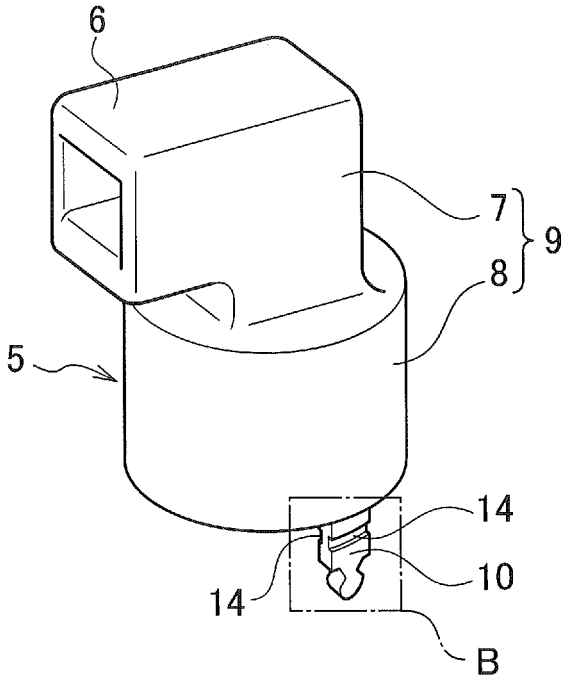
FIG. 11A is a perspective view of a third connector of the connector device according to the embodiment.
Figure 11B:
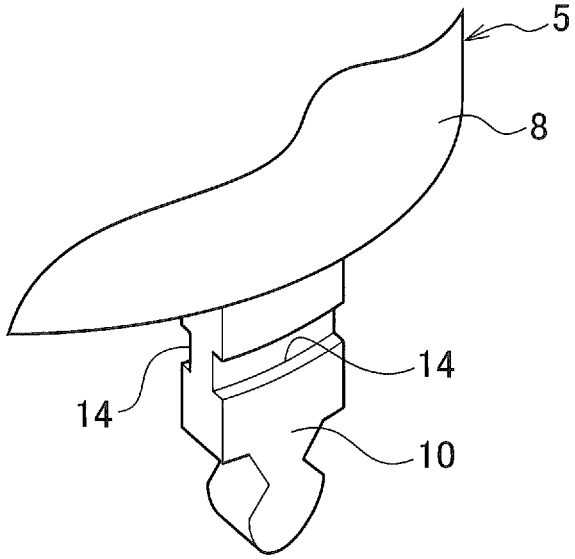
FIG. 11B is an enlarged perspective view of a portion B of FIG. 11A.

In the third housing part 9, a rotation preventing rib 10 is formed so as to project downwardly. As illustrated in FIGS. 7 and 8, the first housing part 4 includes a rotation enabling ring groove 11 in which the rotation preventing rib 10 is rotatably arranged, a plurality of rotation preventing walls 12 provided at intervals farther in the direction of fitting than the rotation enabling ring groove 11, and a plurality of rib fitting grooves 13 which are formed in respective gaps between adjacent rotation preventing walls 12 and into which the rotation preventing rib 10 is fitted.

The rotation preventing rib 10 includes slide concave grooves 14. The first housing part 4 is provided, on its side close to the rotation enabling ring groove 11, with slide convex parts 15 which can enter the slide concave grooves 14. In the position where the rotation preventing rib 10 is rotatably arranged in the rotation enabling ring groove 11, the slide convex parts 15 are inserted into the slide concave grooves 14.

Figure 5B:
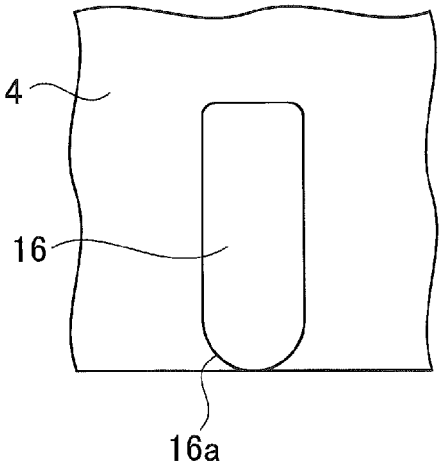
FIG. 5B is a front view of a guide rib of the connector device according to the embodiment.
Figure 6:
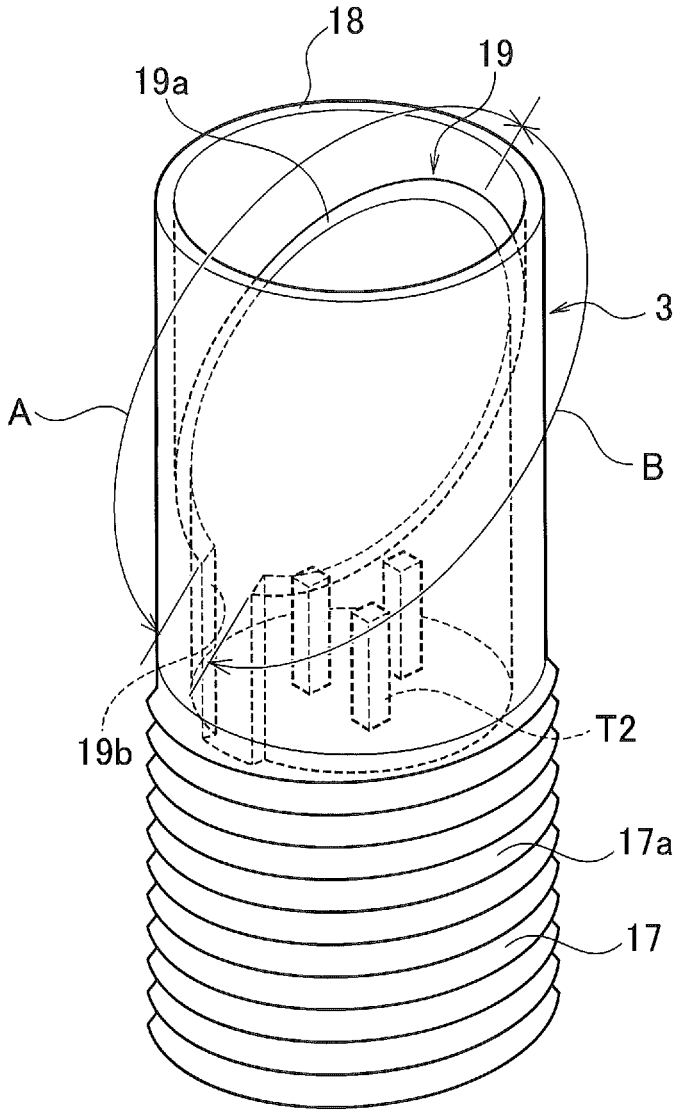
FIG. 6 is a perspective view of a sensor side connector of the connector device according to the embodiment.

On the lower end side of the first housing part 4, a guide rib 16 is formed so as to project on the outer circumference of the part 4. As illustrated in FIG. 5B, the guide rib 16 is formed, on the whole area of its lower end face, with a circular face 16*a*. The circular face 16*a* is formed so as to be the lowest at its center and gradually rise upward on both sides of the center.

The sensor side connector 3 includes a sensor body part 17 in which a combustion pressure sensor element (not illustrated) is disposed, an outer guide cylindrical part 18 fixed to the sensor body part 17, and a second housing part 19 fixed to the sensor body part 17 and arranged in the outer guide cylindrical part 18.

A threaded part 17*a* is formed on the outer circumference of the sensor body part 17. By screwing the sensor body part 17 into a threaded hole 21*a* of the cylinder head 21, the sensor side connector 3 is installed in the cylinder head 21 (see FIG. 4). Owing to such a screw fastening, the second housing part 19 of the sensor side connector 3 is not installed in a particular orientation (rotational position) but in an optional orientation (rotational position).

The outer guide cylindrical part 18 is cylindrical shaped and its surface on the top of the part is opened.

The second housing part 19 is cylindrical shaped and its surface on the top of the part is opened. In the second housing part 19, male terminals T2 as second terminals are arranged in a fitting chamber whose top surface is opened. The male terminals T2 serve to pick up an output from the combustion pressure sensor element.

The second housing part 19 is in the form of a cylinder whose top end face is cut obliquely. This oblique top end face is defined as a guide rail face 19*a* forming a rotating direction guide part. That is, the guide rail face 19*a* is an inclined surface that is the highest at an opposite position to the formal fitting rotational position and the lowest at the formal fitting rotational position. When the guide rib 16 abuts to the guide rail face 19*a*, the guide rail face 19*a* guides the guide rib 16 so that the first housing part 4 and the second housing part 19 are brought into the formal fitting rotational position by a fitting position previous to the time when the female terminals 11 start to come into contact with the male terminals T2.

The second housing part 19 is formed with a straight guide groove 19*b* which opens at the lowermost position of the guide rail face 19*a*. The guide groove 19*b* restricts rotation of the guide rib 19 and also permits only a movement of the first housing part 4 to fit the second housing part 19 at the formal rotational fitting position. Once the guide rib 16 enters the guide groove 19*b*, the contact between the female terminals T1 and the male terminals T2 begins. Then, at a fitting complete position where the guide rib 16 enters the innermost part of the guide groove 19*b*, the female terminals T1 and the male terminals T2 are brought into their appropriate contact condition.

With the above mentioned constitution, the sensor side connector 3 is installed in the cylinder head 21 and thereafter, the head cover 22 is mounted on the cylinder head 21. In the head cover 22, a hole 22*a* is formed at the fitting position of the sensor side connector 3, and the wire harness side connector 2 is assembled through this hole 22*a*.

Figure 14A:
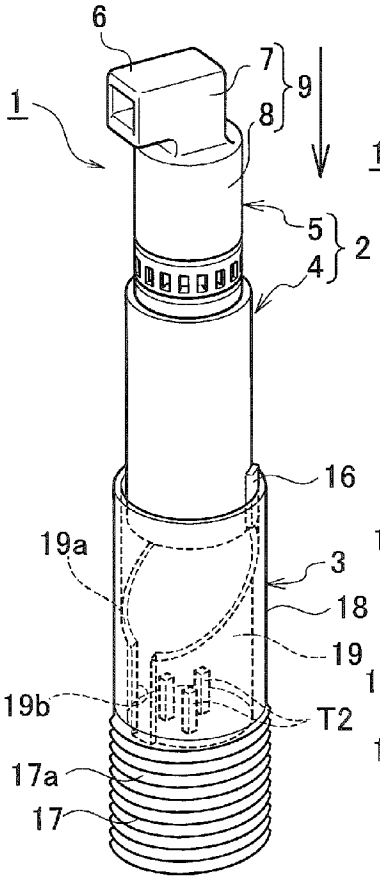
FIGS. 14A to 14D are perspective views illustrating respective fitting processes of each connector of the connector device according to the embodiment.
Figure 14B:
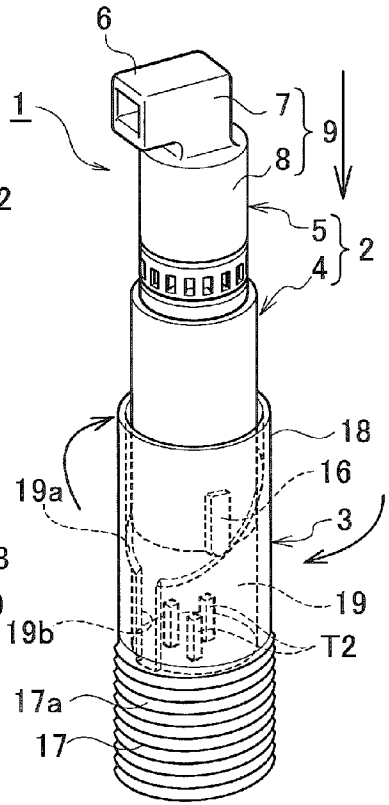
Figure 14C:
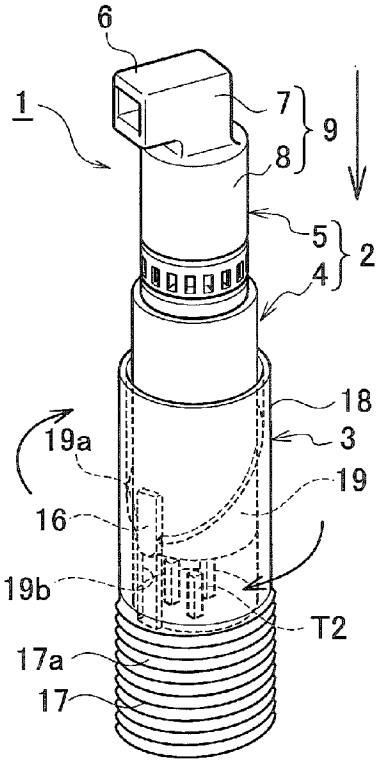
Figure 14D:
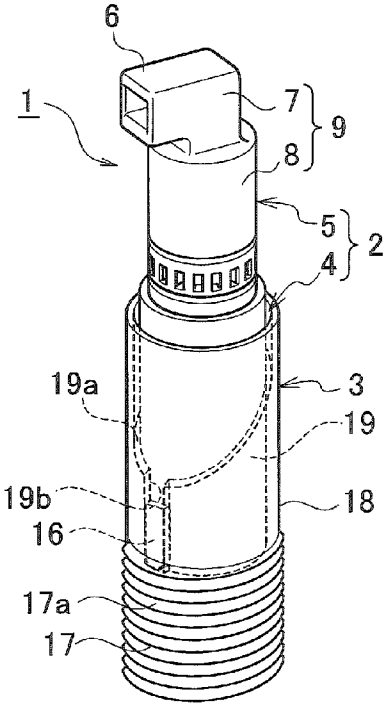

Next, the assembling operation of the wire harness side connector 2 will be described. First, the wire harness side connector 2 is inserted into the outer guide cylindrical part 18 through the hole 22*a* of the head cover 22. Then, except a situation of inserting the first housing part 4 into the second housing part 19 at the formal fitting rotational position, the guide rib 16 of the first housing part 4 abuts on the guide rail face 19*a* of the second housing part 19 at an arbitrary point on that face, as illustrated in FIG. 14A. Then, as illustrated in FIG. 14B, if the guide rib 16 abuts on an area A of FIG. 6, the first housing part 4 moves in a direction to deepen its fitting while simultaneously rotating in a counterclockwise direction. Meanwhile, if the guide rib 16 abuts in an area B of FIG. 6, the housing part 4 moves in a direction to deepen its fitting while simultaneously rotating in a clockwise direction (FIG. 14B illustrates this state). In this way, as illustrated in FIG. 14C, the first housing part 4 is brought into a rotational position where the guide rib 16 is located in the lowermost position of the guide rail face 19*a*. Consequently, the first housing part 4 and the second housing part 19 are located at the formal fitting rotational position. Subsequently, when deepening the fitting of the first housing part 4, the guide rib 16 enters the straight guide groove 19*b* and is inserted up to the fitting complete position, as illustrated in FIG. 14D. In the process for the guide rib 16 to advance in the straight guide groove 19*b*, the female terminals T1 and the male terminals T2 start to connect with each other and thereafter, they occupy an appropriate connecting position at the fitting complete position. Thus, the fitting together of the first housing part 4 and the second housing part 19 is completed.

Additionally, if the first housing part 4 and the second housing part 19 start to fit each other under condition that they are located at the formal fitting rotational position, then the guide rib 16 directly enters the straight guide groove 19*b* without sliding on the guide rail face 19*a* and is inserted up to the fitting complete position, as illustrated in FIG. 14D.

Figure 12B:
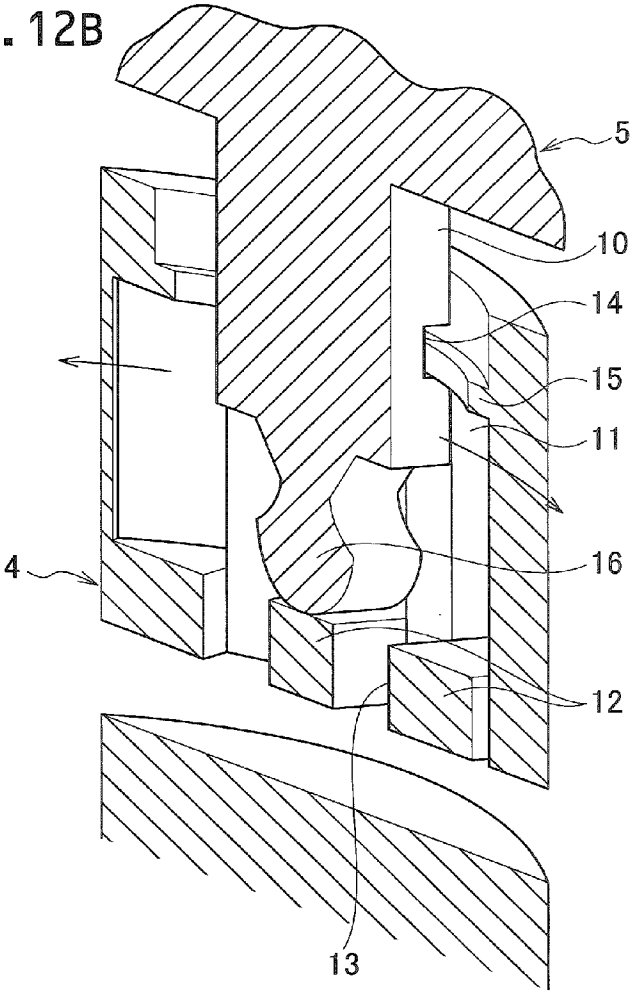
FIG. 12B is a sectional perspective view of the connector device according to the embodiment before a rotation preventing rib is engaged with a rib fitting groove.
Figure 12A:
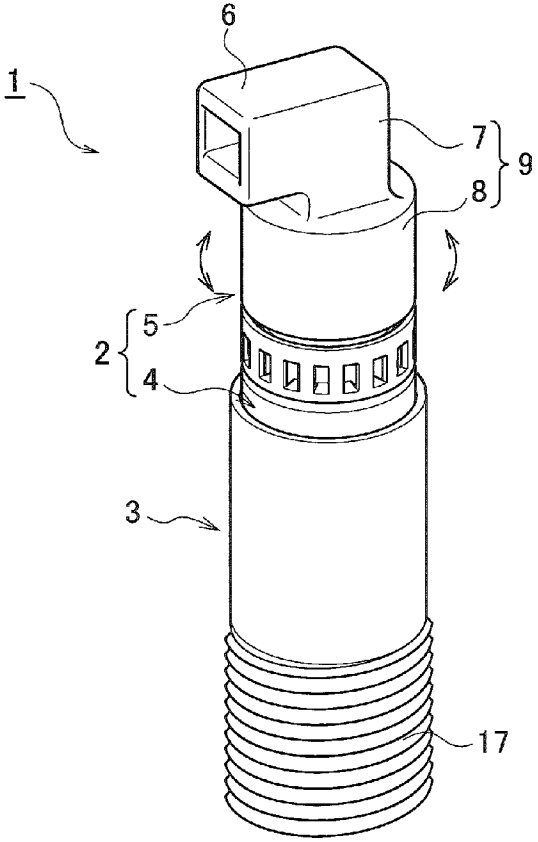
FIG. 12A is a perspective view of the connector device according to the embodiment during rotation of the wire harness side connector.
Figure 13B:
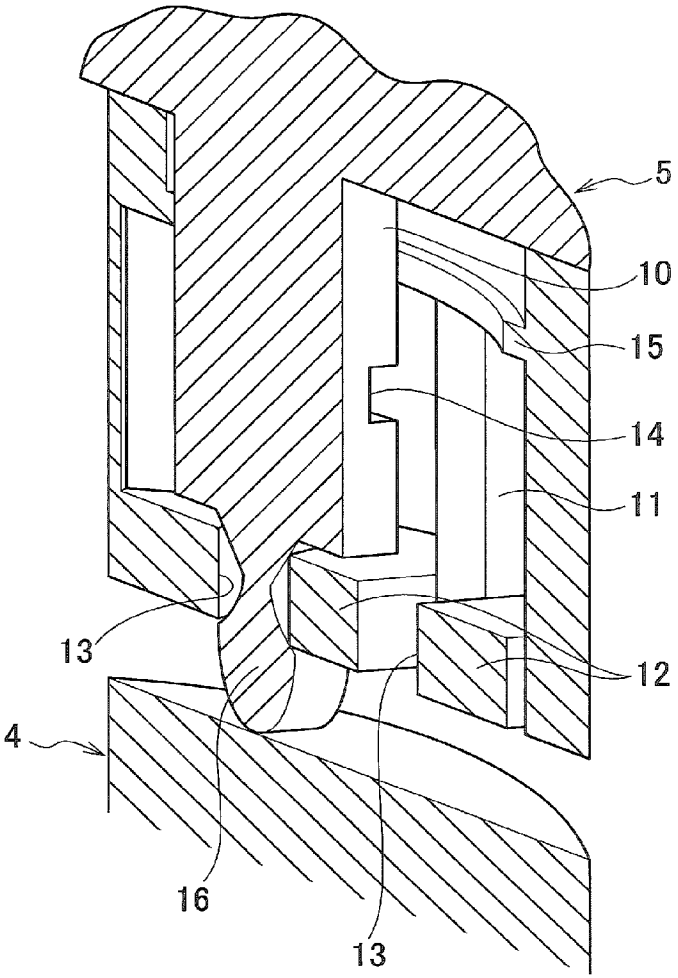
FIG. 13B is a sectional perspective view of the connector device according to the embodiment under condition that the rotation preventing rib is engaged with the rib fitting groove.
Figure 13A:
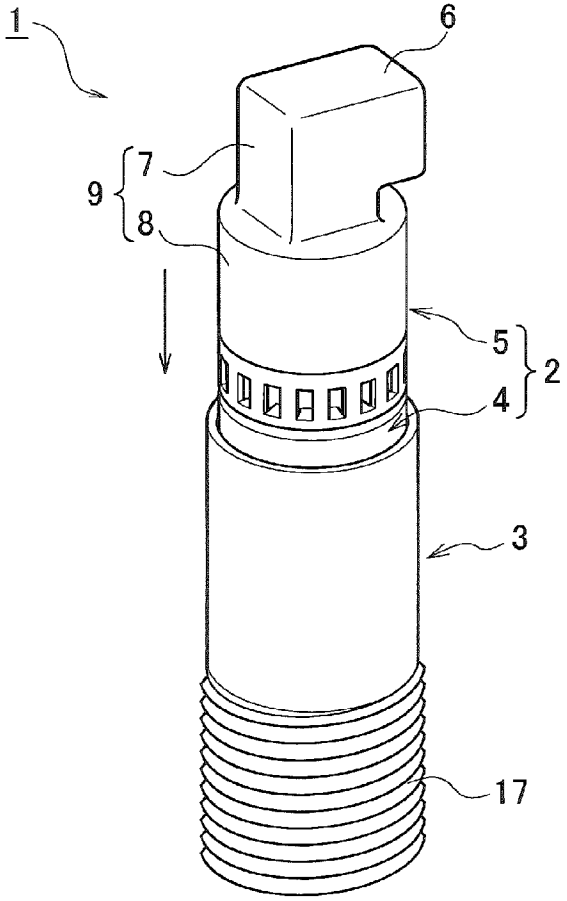
FIG. 13A is a perspective view of the connector device according to the embodiment under condition of lowering the wire harness side connector.

Next, when altering the orientation of an opening of the connector fitting part 6, provided the rotation preventing rib 10 is disposed in the rotation enabling ring groove 11 as illustrated in FIG. 12B, it is performed to rotate the first housing part 4 in relation to the second housing part 19 to the direction of arrows of FIG. 12A, thereby setting the orientation of the first housing part 4 so that the orientation of the opening of the connector fitting part 6 becomes a desired orientation. During this rotation, as the slide convex part 15 and the slide concave groove 14 serve to guide the rotation, the smooth rotation is realized. Next, the first housing part 4 and the third housing part 9 are displaced in the direction to deepen their fitting (i.e. direction illustrated with an arrow of FIG. 13A). As a result, if the rotation prevention rib 10 is fitted to any rib fitting groove 13 as illustrated in FIG. 13B, then the third housing part 9 is fixed to the first housing part 4 at this rotational position.

As described above, the connector device 1 has the rotation preventing rib 10 projecting against the third housing part 9 downwardly and permits a rotation of the third housing part 9 by the rotation enabling ring groove 11 provided in the first housing part 4, thereby making the orientation of the opening of the connector fitting part 6 accord with a desired orientation. Next, with pushing down of the first housing part 4 and the third housing part 9, the rotation of the third housing part 9 is prevented by the plurality of rotation preventing walls 12 and the plurality of rib fitting grooves 13 provided in the first housing part 4. Accordingly, the connector fitting part 6 in the desired orientation can be fitted to the wire harness side connector 2. Additionally, since the slide convex part 15 and the slide concave groove 14 serve to guide the rotation under condition that the rotation preventing rib 10 is rotatably arranged in the rotation enabling ring groove 11, it is possible to rotate the first housing part 4 in relation to the third housing part 9 smoothly.

In this embodiment, the connector device 1 has the first housing part 4, which is adapted so as to be rotatable to the body part 7 and also provided with the guide rib 16, and the second housing part 19 which is provided with the guide rail face 19*a* as the rotating direction guide part that, even if the guide rib 16 is positioned at any rotational position, would guide the guide rib 16 up to the formal rotational position by a position where the female terminals T1 and the male terminals T2 start to connect with each other. Therefore, even if the first housing part 4 and the second housing part 19 start to fit each other in a situation where they are not positioned in the formal fitting rotational position, the first housing part 4 and the second housing part 19 would be brought into the formal fitting rotational position by the guide rib 17 and the guide rail face 19*a* by the time when the female terminals T1 and the male terminals T2 start to connect with each other. Therefore, even if an operator is ignorant of the rotational position of the second housing part 19 of the sensor side connector 3, the fitting operation of the first housing part 4 and the second housing part 19 could be executed with ease.

In the above mentioned embodiment, the first housing part 4 is provided with the rotation preventing rib 10, while the third connector 5 is provided with the rotation enabling ring groove 11, the rotation preventing walls, and the rib fitting grooves 13. In the modification, conversely, the first housing part 4 may be provided with the rotation enabling ring groove 11, the rotation preventing walls, and the rib fitting grooves 13, provided that the third connector 5 is provided with the rotation preventing rib 10.

In the above mentioned embodiment, the first housing part 4 of the wire harness side connector 2 is provided with the guide rib 16, while the second housing part 19 of the sensor side connector 3 is provided with the guide rail face 19*a*. In the modification, conversely, the first housing part 4 of the wire harness side connector 2 may be provided with the guide rail face 19*a*, provided that the second housing part 19 of the sensor side connector 3 is provided with the guide rib 16.

Although the connector device 1 of the above mentioned embodiment is equipped with the combustion pressure sensor element (not illustrated) integrally and further installed in the cylinder head 21 of the engine 20, the present application is not limited to this arrangement. The present application is applicable to a connector device, for example, whether or not a sensor element is present and also applicable to even a connector device integrally equipped with a component other than the sensor element. Although the connector device of the present application is effective in a situation that a counterpart side housing part cannot be identified visually, the present application is available in even a situation that the counterpart side housing part is visible. That is, it is possible to perform the fitting operation without giving consideration to the orientation (rotational position) of the counterpart side housing part, with ease.

What is claimed is:

1. An electrical connector device, comprising:

a first connector including a first housing part in which a first terminal is disposed;

a second connector including a second housing part in which a second terminal is disposed, wherein the first terminal and the second terminal are connected together at a fitting complete position of the first housing part and the second housing part, which results from fitting together of the first housing part and the second housing part;

the first connector includes a third connector rotatably attached to the first housing part, the third connector includes a third housing part including a connector fitting part, having a third terminal therein, an orientation of the connector fitting part is varied by a rotating direction of the first housing part, one of the first housing part and the third housing part is provided with a rotation preventing rib, and the other of the first housing part and the third housing part is provided with: a rotation enabling ring groove in which the rotation preventing rib can be disposed rotatably; a plurality of rotation preventing walls provided therein at intervals farther in the direction of fitting than the rotation enabling ring groove; and a plurality of rib fitting grooves, each of which is formed in a gap between adjacent rotation preventing walls and which are capable of receiving an end of the rotation preventing rib.

2. The electrical connector device of claim 1, wherein the rotation preventing rib is provided with a slide concave groove, either the first housing part or the third housing part, which is provided with the rotation enabling ring groove, is provided with an annular slide convex part which can be inserted into the slide concave groove, and when the rotation preventing rib is rotatably arranged in the rotation enabling ring groove, the slide convex part is inserted into the slide concave groove.

3. The connector device of claim 1, wherein:

one of the first housing part and the second housing part is provided with a guide rib, and the other of the first housing part and the second housing part is provided with a rotating direction guide part which guides the guide rib in a manner that even if the guide rib is positioned at any rotational position, the first housing part and the second housing part would be brought into a formal fitting rotational position by a position previous to the time when the first terminal and the second terminal start to come into contact with each other.

* * * * *